US007001085B2

(12) United States Patent
Rider et al.

(10) Patent No.: US 7,001,085 B2
(45) Date of Patent: Feb. 21, 2006

(54) METHOD AND SYSTEM FOR PROCESSING OF PHOTOGRAPHIC MATERIALS

(75) Inventors: Christopher B. Rider, Surrey (GB); Nicholas J. Dartnell, Hertfordshire (GB)

(73) Assignee: Eastman Kodak Company, Rochester, NY (US)

( * ) Notice: Subject to any disclaimer, the term of this patent is extended or adjusted under 35 U.S.C. 154(b) by 620 days.

(21) Appl. No.: 10/144,497

(22) Filed: May 13, 2002

(65) Prior Publication Data

US 2002/0175081 A1 Nov. 28, 2002

(30) Foreign Application Priority Data

May 18, 2001 (GB) ..... 0112180

(51) Int. Cl.
*G03D 3/02* (2006.01)
*G03D 13/00* (2006.01)

(52) U.S. Cl. ..... 396/578; 396/626; 430/398; 355/27; 204/228.4; 205/335; 205/349

(58) Field of Classification Search ..... 396/578, 396/626; 355/27–29, 40, 41; 430/398–401, 430/413; 204/228.4; 205/335
See application file for complete search history.

(56) References Cited

U.S. PATENT DOCUMENTS 4,078,983 A * 3/1978 Higgins ..... 204/229.2
4,204,930 A 5/1980 Ono et al.
4,207,157 A 6/1980 Hirai et al.
4,744,874 A 5/1988 Toulson
5,118,595 A * 6/1992 Ishikawa ..... 430/399
5,451,298 A * 9/1995 Ueffinger ..... 205/335
5,669,029 A 9/1997 Fyson et al.
5,701,545 A 12/1997 Fyson et al.
5,736,304 A 4/1998 Rider et al.
5,801,813 A * 9/1998 Morimoto et al. ..... 355/27
5,961,939 A 10/1999 Kulp et al.
6,102,589 A 8/2000 Michiels et al.

FOREIGN PATENT DOCUMENTS

DE 41 27 454 2/1993
EP 0 297 479 1/1989
EP 0 741 323 A1 11/1996
EP 0 742 481 11/1996
GB 2 004 310 3/1979

OTHER PUBLICATIONS

F.L. Shippey "Bleach-fix regeneration monitoring method" Research Disclosure, vol. 155, No. 44, Mar. 1977, pp. 74-75, Industrial Opportunities Ltd. Havant, Hampshire, GB.

* cited by examiner

*Primary Examiner*—D. Rutledge

(57) ABSTRACT

A method of processing photographic material includes the steps of processing the photographic material in a processing solution, monitoring the concentration of a process-retarding by-product of the processing in the processing solution during operation of the method, reducing the concentration of the by-product in the processing solution by a first method and as the by-product concentration in the processing solution exceeds a predetermined level, activating simultaneous operation of a second method for a period of time to thereby ensure that the photographic material is always adequately processed. The invention enables rapid processing of film whilst maintaining low replenishment rates and low fixer solution temperature such that inadequately fixed film is avoided.

12 Claims, 2 Drawing Sheets

METHOD AND SYSTEM FOR PROCESSING OF PHOTOGRAPHIC MATERIALS

CROSS REFERENCE TO RELATED APPLICATIONS

Reference is made to commonly assigned, U.S. patent application Ser. No. 10/144,632 entitled A METHOD AND SYSTEM FOR CALCULATING THE FRACTIONAL EXPOSURE OF PHOTOGRAPHIC MATERIAL by Nicholas J. Dartnell et al., filed concurrently herewith.

FIELD OF THE INVENTION

The present invention relates to a method and system for the processing of photographic materials. The invention relates in particular to the processing of black and white photographic materials such as those used in graphic arts.

BACKGROUND OF THE INVENTION

In recent years, there has been a trend towards more rapid processing of photographic material, such as silver halide films, together with reduced replenishment rates. Typically, graphic arts processors have identical path lengths in developer, fixer and wash baths. This enables identical racks to be used with a consequent reduction in cost of the processing machine. With equal development and fixing times, therefore, the rate determining process step has typically been development. A user sets a development time, which is sufficiently long to produce good quality results and the fixing time is automatically set to the same figure. Since the time required for adequate fixing has generally been shorter than the time required for adequate development, this has not been a problem. However, under certain conditions, where development times are shortened, or where for some reason, the time required for adequate fixing is increased, then fixing may become the rate determining process step.

Similar situations can also arise in colour processes, where the development and fixing times may not be equal, but where they are linked in a fixed ratio.

It can occur that the by-products of a particular processing step may actually retard the rate of reaction of that processing step. For example, the halide ions released by the development of silver halide crystals can retard the development reaction. One of the key components in a seasoned fixing stage which retards fixing rate is silver. It is known from, for example U.S. Pat. No. 5,736,304, that fixing rate shows an inverse dependence on fixing stage silver concentration. In the case of certain graphic arts recording films, such as Kodak GEN5 Film GRD™ for example, the fixing time is increased by approximately 1.2 seconds per g/l increase in the silver concentration at a constant fixer replenishment rate. Thus, 6 seconds extra are required to fix a film when the silver concentration in the fixing stage is 10 g/l than when the concentration is 5 g/l.

For a given fixing time each type of photographic material has an upper limit for fixing stage silver concentration at which point the material is just adequately fixed. It is clearly desirable to operate a photographic process in such a way that the silver concentration is less than the upper limit. This may be achieved either by setting the process conditions to ensure a high value of the upper limit or by maintaining a low value of silver concentration.

To address this, methods have been proposed, which rely on using an elevated fixer solution temperature to ensure a high value of the upper limit. However, there are a number of disadvantages to this approach. These include increased vapours given off from the fixing stage and an increased tendency for crystals to form on rollers and tank walls of the fixing stage. In addition, energy consumption is increased and there is a greater tendency for the fixer solution to "creep" up the tank wall with the consequent increased risk of contaminating adjacent tanks.

A method of keeping the silver concentration below the upper limit involves setting the fixer solution replenishment rate so that on average, after a suitably large area of film has been processed, the silver concentration will equilibrate to a value less than the upper limit. If the user makes a substantial change to the average image density on the photographic material then it may be necessary to change the fixer solution replenishment rate, but normally this approach works well, although it may require higher fixer solution replenishment rates than are desirable from a cost or environmental viewpoint.

A problem arises, however, when a user requires rapid processing as well as low fixer solution replenishment rates. The rapid processing requirement decreases the upper limit whereas the low fixer solution replenishment rate increases the silver concentration.

In these circumstances one approach is to reduce the silver concentration by recirculating the fixer solution through a silver recovery unit, which removes silver and then returns the de-silvered solution to the fixing stage. In-line electrolytic silver recovery is a well known example of this technique. Examples of other possible approaches use chemical precipitation, ion exchange or metal exchange for the treatment technology.

Electrolytic silver recovery has a further benefit of reducing fixer replenishment rates as well, since silver complexes are split during electrolysis, with the silver plating out on the cathode of the silver recovery unit and fixing agent being regenerated. Reductions in replenishment rate of up to a factor of two are possible when using in-line electrolytic silver recovery. Furthermore, the lower average silver concentration in the fixing stage results in less silver salts being carried over into downstream processing baths. For black and white processors, this results in a lower silver concentration in the wash bath and for many countries, this enables users to discharge wash water directly to drain without exceeding discharge limits.

A problem with most electrolytic silver recovery units is that they are not able to remove the silver at the same rate as it is introduced to the fixer during film processing. Indeed, for a current of 1 Amp, which is typical of many small silver recovery units, the ratio of the rate of input of silver to the rate of removal of silver by electrolysis is approximately 40 to 1. Clearly, these units are not able to cope with high throughput peaks and maintain the silver concentration below the upper limit.

The problem of reaching the upper limit is more likely to occur with users who batch their film processing. This may happen for example if a roll of film is exposed off-line and then the whole roll is processed in one go. Another situation which might arise is when jobs are sent to a batch queue and then the whole batch is run together—possibly overnight. The batch queue might also be used for an on-line exposing system where several users are sending jobs to a batch queue. If jobs arrive at the queue faster than they can be exposed and processed, the queue will lengthen and the processing will be continuous.

United Kingdom Patent No. GB 2,004,310 in the name of L'Accessorio Radiografico SpA discloses the use of in-line electrolytic silver recovery to maintain the silver concentration of the fixer solution below a predetermined level. European Patent Application having publication number EP 0,279,479 and U.S. Pat. No. 4,744,874 in the name of Toulson describe a two-stage electrolytic treatment of fixer solution. The first stage is an in-line unit in which the fixer solution is subjected to electrolysis using a current of between 0.3 and 2 Amps and the second stage is a terminal treatment unit prior to the fixer solution being discarded. The fixer solution is continuously recirculated from the fixing stage through the in-line unit and back to the fixing stage.

Problem to Be Solved By the Invention

A system for and method of processing photographic material is required that can provide rapid processing at low fixer solution replenishment rate. In particular, for processing systems that are equipped with in-line fixer solution treatment systems, a method is required which can ensure that photographic material processed is always adequately fixed, even under conditions of high peak throughput, without wasting fixer solution and without requiring continuous high fixer solution temperature.

SUMMARY OF THE INVENTION

According to a first aspect of the present invention, there is provided a method of processing photographic material, comprising the steps of processing the photographic material in a processing solution; monitoring the concentration of a process-retarding by-product of the processing in the processing solution during operation of the method; reducing the concentration of the by-product in the processing solution by a first method; and, as the by-product concentration in the processing solution exceeds a predetermined level, activating simultaneous operation of a second method for a period of time, thereby to ensure that the photographic material is always adequately processed.

According to a second aspect of the present invention, there is provided a photographic processing system, comprising at least one processing stage; by-product concentration monitoring means to monitor the concentration of a process-retarding by-product of the process in the processing stage; means for reducing the concentration of said by-product in the processing solution by a first method; and, means for simultaneously operating a second method for a period of time, operation of the second method being activated as the by-product concentration in the processing solution exceeds a predetermined level thereby to ensure that the photographic material is always adequately processed.

Advantageous Effect of the Invention

The invention provides a method of photographic processing and photographic processing system controlled such that the photographic material is always adequately fixed. When the system includes an in-line electrolytic silver recovery unit on the fixing stage (which is itself good for the environment and which reduces costs), it enables rapid processing of film whilst maintaining low replenishment rates and low fixer solution temperature. In addition, the system is arranged such that the control is performed automatically and no operator intervention is required. Therefore, inadequately fixed film is avoided.

Without the method and system of the present invention, if it is desired to ensure that the photographic material is always adequately fixed, it is necessary to operate with a time/temperature/replenishment rate corresponding to the extreme periods of the highest load. This is wasteful in chemistry and time and the present invention provides a method and system for overcoming these deficiencies.

BRIEF DESCRIPTION OF THE DRAWINGS

An example of the present invention will now be described in detail with reference to the accompanying drawing, in which.

DETAILED DESCRIPTION OF THE INVENTION

Figure 1:
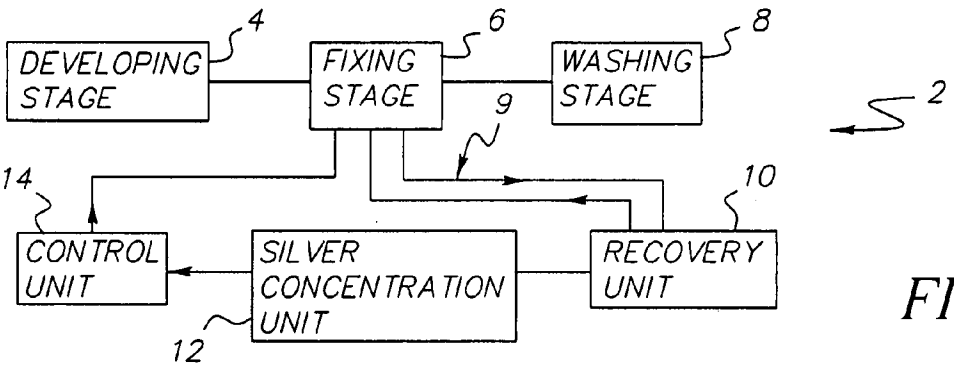
FIG. 1 shows a schematic representation of an example of a photographic processing system according to the present invention.

FIG. 1 shows a schematic representation of an example of a photographic processing system according to the present invention. The system 2 has a developing stage 4 arranged to receive photographic material (not shown) such as exposed silver halide film. The photographic material may include both colour material and black and white material, for example, microfilm, X-ray materials, high contrast materials and printing plates, or any other light-sensitive silver containing material. Once developed, the photographic material proceeds to the fixing stage 6 where the exposed image is fixed, from where it proceeds to a washing stage 8 and then to a drying stage (not shown). An in-line silver recovery unit 10 is provided coupled to the fixing stage 6 arranged to recover silver from the fixer solution within the fixing stage 6. A circulation loop 9 is provided to couple fixer solution from the fixing stage 6 to the in-line silver recovery unit 10 and back to the fixing stage 6 after it has passed through the in-line silver recovery unit 10. A silver concentration determination unit 12 is also provided to determine the concentration of silver in the fixing stage. In the example shown, this is done by a calculation involving the silver mass recovered by the in-line silver recovery unit 10. A control unit 14 is provided to receive a signal from the silver concentration determination unit 12 in dependence on the concentration of silver in the fixer solution within the fixing stage 6 and provide a corresponding control signal to the fixing stage 6.

As will be explained below, if the silver concentration in the fixer solution is below a predetermined limit no action is taken and the processing system is controlled to continue operating in its usual manner. If however the silver concentration in the fixer solution is above the predetermined limit, the control unit 14 takes remedial action. The remedial action taken may involve one or more of a number of different possibilities.

In other words, the in-line silver recovery unit 10, together with silver concentration determination unit 12 and the control unit 14, serve to monitor continually the fixer solution silver concentration during use of the processor. If the silver concentration increases beyond the predetermined limit specific to the film and processor conditions at the selected processing time, then appropriate action is taken to adjust either the upper limit or the silver concentration to ensure that the silver concentration is less than the upper limit. This may involve reducing the silver concentration or increasing the upper limit.

The value of the upper limit for a given set of processing conditions, is dependent on the level of fixing at which it can be said that the photographic material is adequately fixed. In some situations it may be sufficient that the film leaves the fixing stage just fully cleared. This can be somewhat difficult to determine experimentally since fixing can continue within the emulsion layers of the film even after the film leaves the fixer solution. Alternatively, it may be required that the film is fully cleared a certain number of seconds before leaving the fixing stage. For example, it may be required that the total fixing time is twice as long as the clearing time. This requirement provides a safety margin of time to permit more of the soluble silver salts to be washed out of the film in the fixing stage. This is described in, for example, U.S. Pat. No. 6,102,589.

Another way of determining the upper limit is as a limit on residual silver in the film after processing. This definition relates to the archival keeping requirements of the processed film. If the film is not well-fixed, it will bring in more silver to the wash and hence will not be adequately washed. Alternatively, there may be a limit on residual silver in the film after leaving the fixing stage. This definition relates to the silver load carried into the wash. Such a definition might be used where the silver concentration in the wash effluent is desired to be kept below a certain level for legal discharge to drain Whatever definition for the upper limit is selected, it is measured experimentally for the desired processing conditions (fixer solution temperature and time). This is preferably done under the actual conditions that are likely to be experienced in use. It is preferable that the developer should already be seasoned before determination of the upper limit. If this is not the case, the developer may be seasoned by processing an appropriate quantity of film at the expected average exposure using the appropriate developer replenishment rate.

With fresh fixer solution in the fixing stage, sheets of film of the largest expected size, exposed to an average amount of light are processed at the expected time or temperature. If time or temperature is likely to be varied during normal processing usage, then it is best, but not essential, to use worst case processing conditions for the determination of the upper limit by selecting the lowest likely operating temperature, the shortest likely processing time and the lowest likely average exposure (assuming negative working photographic materials are being used).

Whilst film is processed, each sheet of film is monitored to determine whether or not it is adequately fixed. As processing continues, the silver concentration in the fixer solution will rise and eventually there will come a point at which the film is just adequately fixed. At this point, processing is stopped and a sample of the fixer solution is taken for silver analysis. Techniques for analyzing fixer solution silver concentration include silver indicator papers, X-ray fluorescence and atomic absorption spectroscopy.

If the silver concentration in the fixing stage seasons to its asymptote without the film becoming inadequately fixed, then either the fixer solution replenishment rate is higher than it needs to be and the experiment should be repeated at a lower replenishment rate or else, the method of this invention is not necessary under the selected processing conditions.

Figure 2:
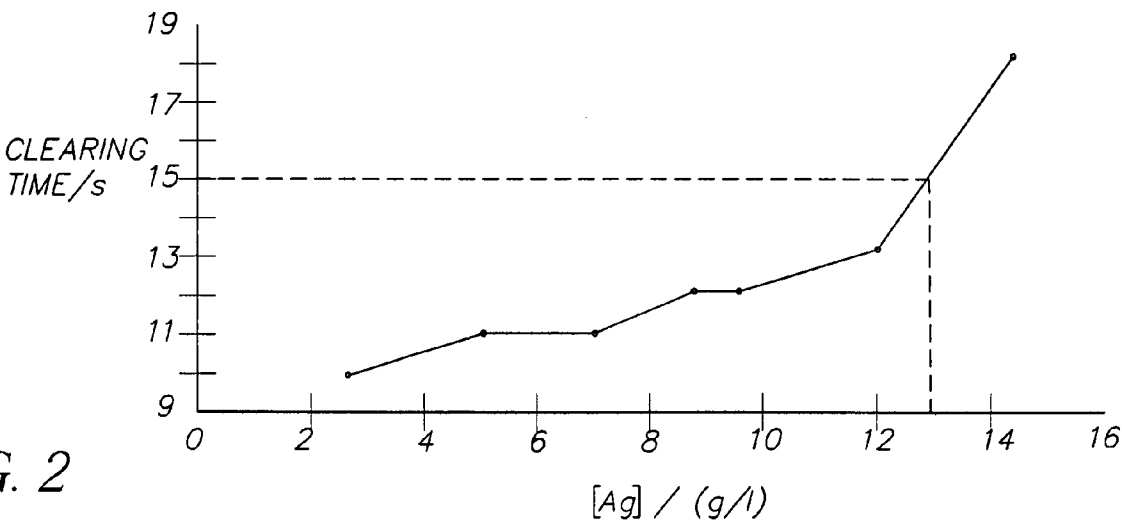
FIG. 2 is a graph showing the variation of fixer solution silver concentration on clearing time for a specific Kodak film.

FIG. 2 shows the effect of fixer solution silver concentration on clearing time for Kodak GEN5 Film GRD at 30° C. through Kodak RA3000 fixer and replenisher seasoned with Kodak RA2000 developer and replenisher. Under these conditions, with the fixing time set to 15 s, the upper limit is 12.8 g/l. If the silver concentration exceeds this value, then clear areas of the film will appear milky, in accordance with the definition of adequately fixed being "just cleared". It is preferable to use a more stringent definition of "adequately fixed" to minimise carryover of silver into the wash bath, in which case, the upper limit would be lower.

Figure 3:
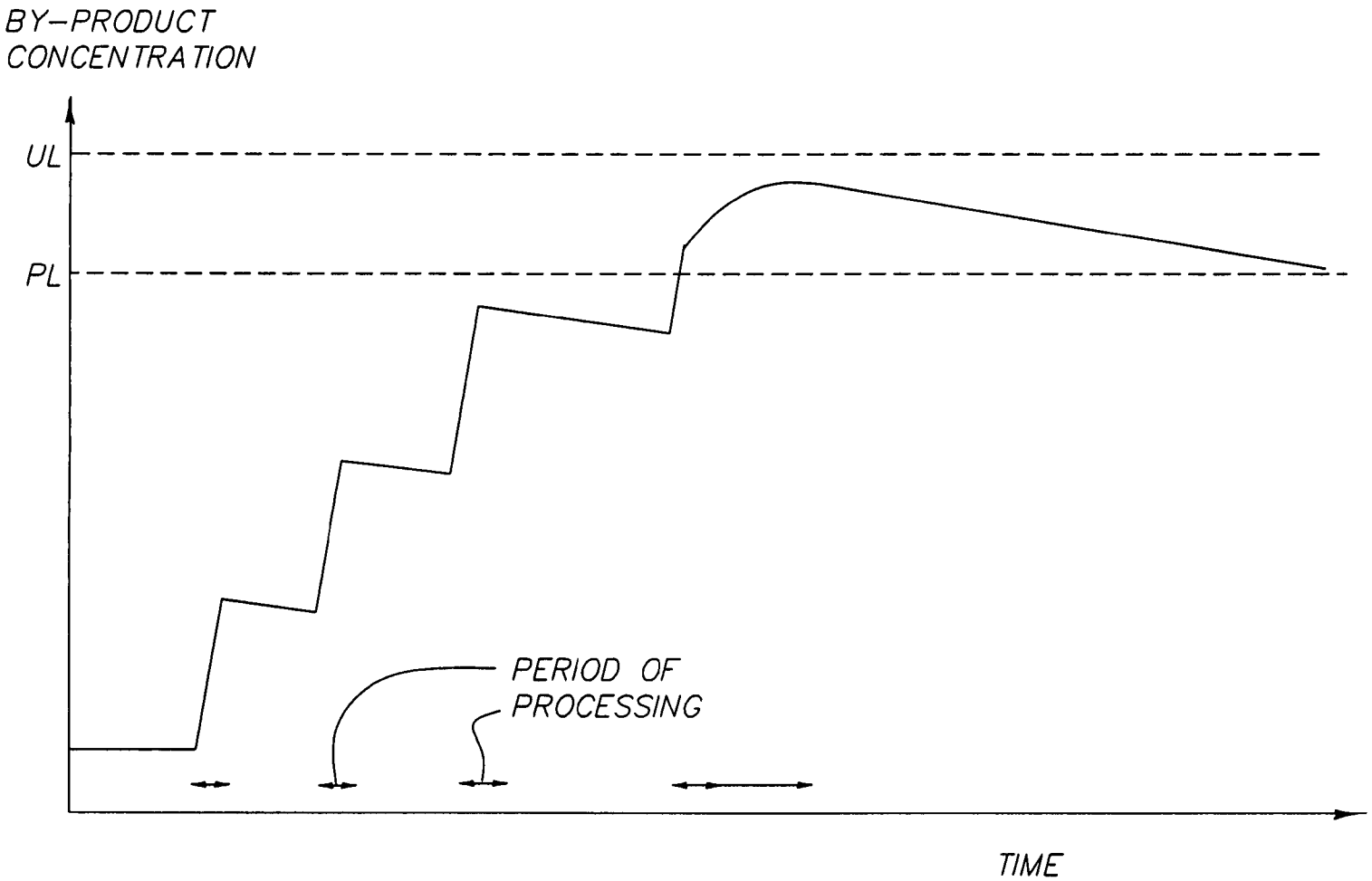
FIG. 3 is a graph showing schematically the variation of silver concentration in a fixing stage with time in accordance with the present invention.

FIG. 3 is a graph showing schematically the variation of silver concentration in a fixing stage with time in accordance with the present invention. A time T=0, the fixing stage silver concentration is relatively low, since this may be at a time at which processing commences following directly on from a period during which silver recovery was in operation. As time progresses and more film is processed, a first method is used to reduce the silver concentration, such as in-line silver recovery. Other options for the first method include metallic replacement and ion-exchange, where the by-product is silver. If the processing solution is a developer in which, for example, halide ions are a process-retarding by-product then an ion exchange cartridge may be used to reduce the concentration of the by-product. Both metallic replacement and ion-exchange are examples of active removal systems in that they remove only certain components of the solution. Dilution and overflow by replenishment is an example of a passive removal system in that all components of the processing solution are diluted. As will be explained below, in-line silver recovery cannot reduce the silver concentration as fast as it is increased by film processing. In many cases, even if the electrolysis current used by the in-line silver recovery unit is increased, the silver concentration will continue to increase. Therefore, between time T=0 and $T=T_1$, there is an overall increase in the silver concentration.

At time $T=T_1$, it is detected that the silver concentration is at a predetermined limit, say within 5% of the upper limit. The photographic processing system is controlled to activate automatically a second method to ensure that the silver concentration does not reach or exceed the upper limit. In the example shown in FIG. 3, the second method does not involve changing the upper limit (for example by increasing the fixer temperature) but reducing the silver concentration (by for example increasing the fixer replenisher rate). As explained above, the upper limit is a maximum value for the silver concentration of the fixing stage above which the film will not be adequately fixed. At time $T=T_2$, it is detected that the silver concentration is now below the predetermined limit so that the second method can be stopped and the system continues with only the first method in operation. In general, the second method may be any suitable method such as increasing the temperature of the processing solution, diluting the processing solution or reducing the amount of photographic material being processed. The present invention therefore enables rapid processing of film without unnecessary use of high replenishment rates and high fixer solution temperature.

In general, the by-product concentration predetermined limit at which it is required that the second method is activated is dependent on each specific system and in particular on which method or methods are to be used as the second method. Typically, the predetermined limit is set at between 0.5 and 0.9 of the upper limit. For example, if the by-product is silver and the upper limit is 10 $gl^{-1}$ the predetermined limit would be typically between 5 $gl^{-1}$ and 9 $gl^{-1}$. For example, it may be in the range 0.0 to 5 $gl^{-1}$ below the upper limit, e.g. 3.0 $gl^{1}$. If it is desired for example to increase the fixer solution temperature when the predetermined limit is exceeded, then the predetermined limit should be set sufficiently below the upper limit such that during the time which is required for the fixer solution to heat up to the new operating temperature, the upper limit at the original temperature is not exceeded as further film is processed during the heating period. The time required to heat up the solution will be dependent on tank volume, heater power and thermal insulation of the tank and will therefore vary from processor to processor.

If it is desired for example to reduce the silver concentration in the fixer solution when the predetermined limit is exceeded, the predetermined limit should be set sufficiently below the upper limit to allow time for the extra fixer replenisher solution to be pumped into the tank as further film is processed. This method might further require that no more film should be processed while the dilution step is being taken, such that a combination of dilution and reducing the area of film processed in a given time period is implemented together.

Other ways of implementing the second method are also possible, when it is detected that the predetermined limit has been exceeded, such as: switching to a different type of fixer replenisher formulated for rapid fixing, switching in another piece of equipment which is capable of removing silver from the fixing solution in-line, such as another electrolytic silver recovery unit or ion-exchange cartridge, or most simply, increasing the processing time so that the upper limit is increased.

There are a number of possible methods of monitoring the fixer silver concentration in real time during processing. For example, direct measurement, calculation techniques or approximate methods using the plating current of the silver electrolysis unit may be used.

Where direct measurement is used, a silver ion electrochemical sensor may be placed in the fixing stage close to the outlet of the tank recirculation system to ensure the fixer solution is well mixed at the point of measurement. Where calculation techniques are used, if the area, silver content and the exposure of the processed film is known it is possible to calculate the amount of silver that will be released into the fixing stage. This assumes, with little significant loss of accuracy, that the diffusion of silver complexes out of the film is allowed to proceed to completion in the fixer solution. If time is short, correction factors may be used as described in U.S. Pat. No. 6,102,589.

The present invention requires that there should be an in-line silver recovery unit associated with the fixing stage. Preferably this is electrolytic silver recovery although other types of silver recovery systems are possible, for example, metallic exchange or ion exchange cartridges, in which case it is possible to monitor the mass of silver recovered by weighing the cartridge. In the case of electrolytic silver recovery, the amount of silver recovered during a given time may be determined from Faraday's law and from a knowledge of the applied electrolysis current as a function of time. A silver mass balance relation may be written for the fixing stage where the silver entering fixer bath is equal to the silver leaving fixer bath plus the change in silver in the fixing stage.

This silver entering the fixing stage is the silver fixed out of the film. In other words, the fixed silver from film is equal to the silver recovered by electrolysis plus silver in overflow and carryout plus the change in silver concentration of fixer bath.

If S is the film's silver coated weight per unit area, A is the area of film processed in a time period T, and E is the fraction of the silver in the area processed which was exposed to light so that all the silver in that area is developed, then it can be said that the fixed silver from film is $S \cdot A \cdot (1-E)$ The silver recovered by electrolysis may be expressed as $K \cdot I \cdot T$, where I is the average current during the time period and K is a constant, assuming that the electrolysis process was conducted at a constant efficiency throughout the period.

The change in silver mass in the fixing stage, $\Delta M$, may be expressed as $V \cdot \Delta C$, where C is the silver concentration in the fixing stage and V is the total volume of solution associated with the fixing stage and the silver recovery unit.

The silver mass leaving the fixing stage through overflow and carryout may be expressed as $(F+f) \cdot A \cdot C_{avg}$ where F is the volume of fixer replenisher added to the fixing stage per unit area of film, f is the volume of fixer solution carried out with the film from the fixing stage per unit area processed and $C_{avg}$ is the average silver concentration in the bath during the processing of the area, A.

It is assumed that the effects of evaporation are negligible since this would form only a very small correction to the calculated silver concentration. Thus:

$$S \cdot A \cdot (1-E) = K \cdot I \cdot T + V \cdot \Delta C + (F+f) A \cdot C_{avg}$$

Rearranging, where $C_f$ is the final silver concentration after processing the area A in a time, T and $C_i$ was the initial silver concentration, gives:

$$C_f - C_i = \{S \cdot A(1-E) - K \cdot I \cdot T - (F+f) A \cdot C_{avg}\}/V$$

S, A, K, I, T, F and V are all known. The term, f, can be easily measured. The unknowns are E, $C_f$, $C_i$ and $C_{avg}$. If the area A is small enough, we may approximate $C_{avg}$ to $(C_f+C_i)/2$ and equation 3 may be rearranged to give $$V \cdot (C_f - C_i) + [F+f] A \cdot (C_f + C_i)/2 = \{S \cdot A \cdot (1-E) - K \cdot I \cdot T\}$$

Or $$(C_f - C_i)(V + [F+f]A/2) + C_i \cdot ([F+f]A/2) = \{S \cdot A \cdot (1-E) - K \cdot I \cdot T\}$$

The only unknowns are now E, $C_f$ and $C_i$ and these may be determined, for example, using the method described in our co-pending U.S. patent application Ser. No. 10/144,632 entitled A METHOD AND SYSTEM FOR CALCULATING THE FRACTIONAL EXPOSURE OF PHOTOGRAPHIC MATERIAL by Nicholas J. Dartnell et al.

Other methods of obtaining E are also possible. For example, some on-line exposing/processing systems are equipped with a link between the exposing and processing devices. In the case where the exposing device is able to compute the average exposure given to the material to be processed, it is possible to send the information over the link to the processor, where it may be used to compute C(t), the real-time fixer silver concentration.

The silver concentration of the fixer solution may also be determined in accordance with approximate methods using the plating current of the silver electrolysis unit. Some silver recovery units are equipped with sensors which either measure silver ion concentration directly, in which case the method described above could be used or which measure conductivity of the fixer solution. Conductivity scales approximately with silver concentration such that the conductivity of the fixer goes up as the silver concentration increases. It also changes in response to other parameters, such as temperature, and the concentration of other ions. However, for a given system on a single processor with a given film and fixer type, operating at a fixed temperature, conductivity can be used to give a useful indication of silver concentration. A conductivity measurement can be taken at the predetermined limit and used in the method of the present invention.

Some silver recovery units operate by various methods to derive a signal which is used to increase or decrease the plating current. The principle of operation is that it is safe to use a high electrolysis current when the silver ion concentration in the fixer solution is high. Therefore, if the predetermined limit corresponds to a silver concentration, which enables a particular plating current to be used, the plating current itself may be used in the method of the present invention.

When it has been determined by any of the methods described above that the predetermined limit has been reached or exceeded, it is necessary to take action to ensure that the fixing of the film is not compromised i.e. to ensure that the upper limit is not reached or exceeded. If electrolytic silver recovery is being used, one possible course of action is to increase the recovery current to the point where the silver concentration no longer increases. However, it is not always possible to increase the current indefinitely due to the increased likelihood of sulphiding in the cell i.e. the unwanted reaction that occurs at high current densities and insufficient mass transport of silver to the cathode surface in which silver sulphide is precipitated in the fixer solution rather than silver being plated at the cathode. This reaction is highly undesirable since it actually destroys the fixing agent as opposed to regenerating it, which is the situation under normal plating conditions. Furthermore, the silver sulphide precipitate is fine and can stick to the film and processor parts, reducing the quality of the processed film. Therefore, if the recovery current cannot be increased further and there remains a risk that the silver concentration will reach or exceed the upper limit, a second method is temporarily used to ensure that the upper limit is not exceeded. Determination or detection that the predetermined limit has been reached acts as a trigger to activate simultaneous operation of the second method. The second method can be used until the silver concentration is reduced to below the predetermined level thereby to provide some robustness to the control of the system. Alternatively, it may be turned off before this once it has been determined that the silver concentration has peaked or at any other time.

The options for the second method are, to:

(a) increase the replenishment rate of the fixing stage to dilute the fixer solution and so reduce the by-product concentration;

(b) increase the temperature of the fixing stage so that complete fixing is maintained;

(c) increase the processing time; or (d) reduce the amount of film being processed per unit time until the primary means of by-product removal, in this example an electrolytic silver recovery unit, is able to bring the silver concentration back below the predetermined limit;

(e) employ additional means for by-product removal from the fixer tank, such as electrolytic silver recovery, metallic replacement or ion-exchange units;

(f) replenish the fixer tank with a special replenisher formulated for rapid fixing and so increase the upper limit;

(g) perform any combination of any of the above.

Options (c) and (d) are not preferred since they reduce the productivity of the processing. However, it is preferable to reduce productivity rather than producing inadequately fixed films if all other options are not possible. Furthermore, no extra cost is required other than the loss of productivity and in some circumstances this may be preferably to increasing fixer replenisher consumption or raising the fixer temperature.

Options (d), (e) and (f) are also not preferred because they require additional processing equipment to be provided. This increases the overall cost of the processing system and its complexity. However, it is known in the art for electrolytic silver recovery equipment to be shared between processors with one unit servicing up to 4 processors. In this way, a silver recovery unit could be shared by several processors, each of which already has its own silver recovery equipment permanently installed. In this case, it would be more cost-effective to switch the resources of the shared silver recovery unit onto a processor in circumstances where the permanently installed silver recovery unit on that processor is not able to maintain the silver concentration below the predetermined limit.

Once the second method has been used and it is determined that the silver concentration is once again below the predetermined limit, it is possible to reverse the action (i.e., switch off the second method) and continue in the normal mode of operation.

A control link between the silver recovery unit and the processor is required so that the silver recovery unit can send a signal to the processor, which will effect control of replenishment rates, temperature, etc. The control link may be executed by a microprocessor (or any other suitable electronic or non-electronic device) arranged to receive a signal from the silver recovery unit and control the processor in dependence on the received signal.

The following example demonstrates the requirement for the method of the present invention:

A single sheet of film measuring 1 square meter with a silver coated weight of 4 g/m$^2$ with an exposure of 10% is processed. The replenishment rate is 150 ml/m$^2$, the carryover from the developer to the fixer on the processed material is 20 ml/m$^2$ and the carryover from the fixer to the wash is 15 ml/m$^2$. The transport speed of the processor is 1 m per minute and the maximum film width, 0.75 m.

The time taken to process 1 m$^2$ of film, $\Delta t=60/0.75=80$ seconds

Mass of silver entering fixer from 1 m$^2$ of film, $M_{film}$=Silver coated weight×(1−fractional area exposed)× area of film=4×(1−0.1)×1=3.6 g The rate of change of silver mass in the fixing stage during the processing of the sheet of film is given by $$\frac{dM_{film}}{dt} = \frac{M_{film}}{\Delta t} = 3.6/80 = 45 \text{ mg/s}$$

The rate of change of silver mass in the fixing stage due to electrolytic silver recovery, where I is the plating current, w is the atomic weight of silver, n is the charge on the silver ion and F is Faraday's constant is given by:

$$\frac{dM_{electrolysis}}{dt} = \frac{w \cdot I}{n \cdot F} = 107.9 \times I / 1 \times 96484.6 = 1.12\ I \text{ mg/s/Amp}$$

So for a current of 1 Amp, which would be typical of many small silver recovery units, the ratio of the rate of input of silver to the rate of removal of silver by electrolysis is about 40 to 1. In practice, the rate of input of silver is not maintained throughout the working day since there may be long gaps between sheets being processed. Furthermore, silver is also removed from the tank by overflow to drain.

The rate of removal of silver through overflow for 1 $m^2$ of film is given by the product of the concentration of silver in the tank times the volume of solution in the overflow divided by the time increment during which the film is in the tank. Where c is the silver concentration, R is the replenishment volume, d is the volume of solution carried in from the developer with the film, f is the volume of solution carried out from the fixer with the film and $\epsilon$ is the evaporation volume occurring during the time increment, it follows that $$\begin{aligned}\frac{dM_{overflow}}{dt} &= \frac{c\cdot(R+d-f-\varepsilon)}{\Delta t}\\ &= c\cdot(0.15+0.02-0.015-\varepsilon)/\Delta t\\ &= c\cdot(0.155-\varepsilon)/\Delta t\end{aligned}$$

Assuming c at the upper limit is 5 g/l and for simplicity, evaporation is zero $$=5.(0.155)/80$$

$$=9.7 \text{ mg/s}$$

For a low throughput of film, with a current of 1 Amp, the silver recovery unit might be able to maintain the silver concentration below 5 g/l but for a high throughput, the silver concentration would certainly rise above 5 g/l. To absolutely guarantee that the upper limit is not exceeded, it would be necessary to use a much higher current. The required current may be calculated from the difference of the rate of input of silver and the rate of loss due to overflow at the upper limit.

$$1.12I=45-9.7$$

$$I=31.5 \text{ Amps}$$

Whilst some larger silver recovery units might use 10 Amps, the required current of 31.5 Amps, ensuring complete certainty of operation below the upper limit, is totally impractical for safety, cost and reasons of avoiding sulphiding in the cell. Even a 10A unit would require the average gap between sheets to be around 3 times as long as the total processing time.

The above example has not taken into account the buffering effect of the fixing stage, which would delay the reaching of the upper limit. The calculation demonstrates, however, that some customers with prolonged high throughput will certainly find that a small silver recovery unit will not be able to maintain the silver concentration below the upper limit. The principle described above, may be used with any photographic processing solution in which the rate of processing is inversely dependent on the concentration of a by-product of the processing reaction occurring and where the by-product is being removed from the tank by some suitable removal means. Examples of the removal means may be electrolytic or metal-exchange. Alternatively, the removal means may be ion-exchange such as bromide removal from developer solution in an ion-exchange column.

It is possible that the upper limit and minimum processing time information may be recorded on a label associated with the film. The label may be machine-readable or form part of machine-readable packaging. For example, a bar-code on the film packaging may be used or the necessary information may be stored as a latent image bar-code on the film itself. If the processor or silver recovery unit to which it is connected has a bar-code reader, the bar-code label may be swiped and the control parameters for that film downloaded into a control system of the processor or silver recovery unit. The bar-code may include data such as minimum processing time for the specific film, fixer type and dilution as a function of fixer silver concentration and temperature, fixer solution replenishment rate below upper limit and silver coated weight of film. A processing system according to the present invention is adapted to be able to read the bar-code and process the film in accordance with the method of the present invention. This provides a convenient and simple way of providing the processing system with the necessary information about film processing characteristics to enable the film to be processed according to the present invention. This approach has been described in U.S. Pat. Nos. 5,701,545 and 5,669,029 in the name of the Eastman Kodak Company.

Although the above description is in relation to black and white graphics films, it will be appreciated that the method and system of the present invention may also be used with any black and white or colour photographic system.

What is claimed is:

1. A method of processing photographic material, comprising the steps of:

processing the photographic material in a processing solution;

monitoring the concentration of a process-retarding by-product of the processing in the processing solution during operation of the method;

reducing the concentration of the by-product in the processing solution by a first method; and, as the by-product concentration in the processing solution exceeds a predetermined level, activating simultaneous operation of a second method for a period of time, thereby to ensure that the photographic material is always adequately processed in which the second method comprises one or more of:

(a) increasing the temperature of the processing solution;

(b) reducing the by-product concentration in the processing solution by dilution; and, (c) reducing the amount of photographic material being processed per unit time.

2. A method according to claim 1 in which the processing solution is regenerated by supply of replenisher solution during processing and wherein when the second method comprises step (b) during operation of the second method, the replenishment rate is increased to reduce the by-product concentration.

3. A method according to claim 1, in which the first method comprises electrolytic recovery of said by-product.

4. A method according to claim 1, in which the processing solution is developing solution and the by-product is halide ions.

5. A method according to claim 4, wherein the upper limit is up to double the predetermined level.

6. A method according to claim 1, wherein the by-product concentration is controlled so that an upper limit wherein the photographic material is not adequately processed is not reached.

7. A method of processing photographic material, comprising the steps of:

processing the photographic material in a processing solution;

monitoring the concentration of a process-retarding by-product of the processing in the processing solution during operation of the method;

reducing the concentration of the by-product in the processing solution by a first method; and, as the by-product concentration in the processing solution exceeds a predetermined level, activating simultaneous operation of a second method for a period of time, thereby to ensure that the photographic material is always adequately processed according to claim 1, in which the first method comprises electrolytic recovery of said by-product.

8. A photographic processing system comprising:

at least one processing stage;

a by-product concentration monitor to monitor the concentration of a process-retarding by-product of the process in the processing stage;

apparatus adapted to reduce the concentration of said by-product in the processing solution by a first method; and, apparatus adapted to simultaneously operating a second method for a period of time, operation of the second method being activated as the by-product concentration in the processing solution exceeds a predetermined level thereby to ensure that the photographic material is always adequately processed in which the second method comprises one or more of:

(a) increasing the temperature of the processing solution;

(b) diluting the processing solution;

reducing the amount of photographic material being processed per unit time; and (d) employing additional apparatus for by-product removal from the processing stage, such as electrolytic recovery, metallic replacement or ion-exchange units.

9. A photographic material having a machine-readable label, the label including information indicative of material composition component levels, a minimum processing time of said material for each of at least one processing solution type or types, dilution of said at least one processing solution type or types as a function of by-product concentration and processing solution temperature, to enable said material to be processed by a processing system according to claim 8.

10. A photographic material according to claim 9, in which the code is a bar-code.

11. A material according to claim 9, wherein the material composition component is silver, the processing solution has fixing ability and the by-product is silver.

12. A photographic processing system comprising:

at least one processing stage:

a by-product concentration monitor to monitor the concentration of a process-retarding by-product of the process in the processing stage;

apparatus adapted to reduce the concentration of said by-product in the processing solution by a first method; and, apparatus adapted to simultaneously operating a second method for a period of time, operation of the second method being activated as the by-product concentration in the processing solution exceeds a predetermined level thereby to ensure that the photographic material is always adequately processed wherein the apparatus adapted to reduce the concentration of by-product in the processing solution by a first method comprises an electrolytic recovery unit.

* * * * *

UNITED STATES PATENT AND TRADEMARK OFFICE

CERTIFICATE OF CORRECTION

PATENT NO. : 7,001,085 B2
APPLICATION NO. : 10/144497
DATED : February 21, 2006
INVENTOR(S) : Christopher B. Rider et al.

It is certified that error appears in the above-identified patent and that said Letters Patent is hereby corrected as shown below:

| | |
|---|---|
| Column 13, lines 14 & 15 | Please replace the text "processed according to claim 1, in which" with the following corrected text, --processed in which-- |
| Column 13, line 34 | Please replaced the text "reduing the amount" with the following corrected text, --(c) reducing the amount-- |

Signed and Sealed this

Twenty-third Day of January, 2007

JON W. DUDAS
*Director of the United States Patent and Trademark Office*